US008650727B2

(12) United States Patent
Takabayashi et al.

(10) Patent No.: US 8,650,727 B2
(45) Date of Patent: Feb. 18, 2014

(54) PROCESS FOR PRODUCING CLEANING SHEET

(75) Inventors: Keima Takabayashi, Tochigi (JP); Minoru Wada, Tochigi (JP); Kenji Ishikawa, Tochigi (JP); Kazutoshi Ootsuka, Tochigi (JP)

(73) Assignee: Kao Corporation, Tokyo (JP)

( * ) Notice: Subject to any disclaimer, the term of this patent is extended or adjusted under 35 U.S.C. 154(b) by 222 days.

(21) Appl. No.: 12/992,559

(22) PCT Filed: May 25, 2009

(86) PCT No.: PCT/JP2009/059536

§ 371 (c)(1),
(2), (4) Date: Dec. 30, 2010

(87) PCT Pub. No.: WO2009/145148

PCT Pub. Date: Dec. 3, 2009

(65) Prior Publication Data

US 2011/0126388 A1 Jun. 2, 2011

(30) Foreign Application Priority Data

May 27, 2008 (JP) ..... 2008-137435

(51) Int. Cl.
*D04H 1/42* (2012.01)
*D04H 1/46* (2012.01)
*D04H 5/02* (2012.01)

(52) U.S. Cl.
USPC ..... 28/104; 28/167

(58) Field of Classification Search
USPC ..... 28/104, 105, 167, 165, 166, 122, 112; 442/384, 408, 387
See application file for complete search history.

(56) References Cited

U.S. PATENT DOCUMENTS 5,143,779 A * 9/1992 Newkirk et al. ..... 428/218
5,334,446 A * 8/1994 Quantrille et al. ..... 442/35

(Continued)

FOREIGN PATENT DOCUMENTS

CN 1365406 A 8/2002
CN 1497086 A 5/2004

(Continued)

OTHER PUBLICATIONS

International Search Report, dated Aug. 11, 2009, issued in PCT/JP2009/059536.

(Continued)

*Primary Examiner* — Amy Vanatta
(74) *Attorney, Agent, or Firm* — Birch, Stewart, Kolasch & Birch, LLP

(57) ABSTRACT

A laminate (6) is prepared by superposing a fibrous web (1*a*), (1*b*) containing fibers comprising polyethylene terephthalate on one side or both sides of a net-form sheet (4); water needling the fibrous web (1*a*), (1*b*) to entangle the fibers of the fibrous web (1*a*), (1*b*) with each other, and also to entangle the fibers of the fibrous web (1*a*), (1*b*) with the net-form sheet (4); and then, blowing hot air having a temperature above the glass transition temperature (Tg (° C.)) of the polyethylene terephthalate and below "Tg (° C.)+70° C." to the laminate (6) by through-air technique. Preferably, after preparing the laminate (6) by entangling the fibers of the fibrous web(s) (1*a*), (1*b*) with the net-form sheet (4), the laminate (6) is dried with hot air; and then hot air is blown to the laminate (6) by through-air technique.

9 Claims, 2 Drawing Sheets

(56) References Cited

U.S. PATENT DOCUMENTS

| | | | | |
|---|---|---|---|---|
| 5,368,925 | A * | 11/1994 | Hosokawa et al. | 442/359 |
| 5,525,397 | A * | 6/1996 | Shizuno et al. | 428/138 |
| 5,789,328 | A * | 8/1998 | Kurihara et al. | 442/387 |
| 6,063,717 | A * | 5/2000 | Ishiyama et al. | 442/387 |
| 6,936,333 | B2 | 8/2005 | Shizuno et al. | |
| 7,131,171 | B2 | 11/2006 | Miyamoto et al. | |
| 7,507,463 | B2 * | 3/2009 | Noda et al. | 428/167 |
| 2003/0008108 | A1 | 1/2003 | Shizuno et al. | |
| 2004/0010895 | A1 * | 1/2004 | Vonfeldt et al. | 28/104 |
| 2004/0111848 | A1 | 6/2004 | Miyamoto et al. | |
| 2007/0298671 | A1 * | 12/2007 | Noda et al. | 442/334 |

FOREIGN PATENT DOCUMENTS

| | | | |
|---|---|---|---|
| EP | 1 403 413 | A1 | 3/2004 |
| JP | 5-25763 | A | 2/1993 |
| JP | 5-192285 | A | 8/1993 |
| JP | 2001-336052 | A | 12/2001 |
| JP | 2003-230519 | A | 8/2003 |
| JP | 2004-137655 | A | 5/2004 |
| JP | 2005-15938 | A | 1/2005 |
| JP | 2007-312931 | A | 12/2007 |
| WO | WO 01/71081 | A1 | 9/2001 |

OTHER PUBLICATIONS

English translation of International Preliminary Report on Patentability (Form PCT/IB/338 and 373) and of Written Opinion of the International Searching Authority (Form PCT/ISA/237) mailed Jan. 20, 2011 in International Application No. PCT/JP2009/059536.

Chinese Office Action for Chinese Application No. 200980118069.1, dated Jun. 26, 2012.

Extended European Search Report dated Aug. 12, 2011, for European Application No. 09754656.8.

Notice of Rejection for corresponding Japanese Patent Appiication No. 2009-125404, dated Jan. 8, 2013.

* cited by examiner

PROCESS FOR PRODUCING CLEANING SHEET

TECHNICAL FIELD

The present invention relates to a cleaning sheet suitably used for trapping and removing dirt such as dust balls, strands of hair, and lint.

BACKGROUND ART

Applicant has previously proposed a technique for producing a bulky sheet, which involves reinforcing a nonwoven fabric made of entangled fibers with a net-form sheet and heat-shrinking the net-form sheet to form projections and depressions thereon (see Patent Literatures 1 and 2). Besides this type of bulky sheet, Applicant has also proposed another type of bulky sheet that includes a fiber aggregate made by water needling of a fibrous web, wherein the fiber aggregate is formed to have a multitude of projections and depressions (see Patent Literature 3). The projections and depressions in this bulky sheet are formed by rearrangement of the constituent fibers of the fiber aggregate due to the water needling process applied thereto, which renders a zigzag form to the fiber aggregate in its thickness direction.

The sheet produced according to the method of Patent Literature 1 or 2 has an appropriate amount and extent of projections and depressions and is soft and pleasant to the touch. However, since the projections are made by heat-shrinking of fibers, the fiber density in the projections tends to become high. Thus, there still is room for improving the capability of the constituent fibers of the projections to trap dirt such as dust balls.

Meanwhile, the sheet produced according to the method of Patent Literature 3 is capable of trapping and retaining dust among the constituent fibers and is also capable of trapping and retaining relatively-large dirt with its projections and depressions, such as bread crumbs that cannot be trapped among the constituent fibers. However, when high-speed production is applied to this type of sheet to increase productivity, the sheet receives a high tension while being carried, and this may reduce the bulkiness of the projections and depressions.

Besides the above-described techniques for producing bulky sheets, Applicant has also proposed an through-air, hot-air processing technique as a method for restoring the bulkiness of a continuous sheet having been wound into a roll shape and whose bulkiness has thus been reduced (see Patent Literature 4). Patent Literature 4, however, describes nothing about the possibility of applying this hot-air processing technique to the production of sheets having the structure as disclosed in Patent Literatures 1 to 3.

CITATION LIST

Patent Literature

Patent Literature 1: JP-A-5-25763

Patent Literature 2: JP-A-5-192285

Patent Literature 3: U.S. Pat. No. 6,936,333 B2

Patent Literature 4: U.S. Pat. No. 7,131,171 B2

SUMMARY OF INVENTION

Technical Problems

An aspect of the present invention relates to a process for producing a cleaning sheet that can overcome the drawbacks of the conventional techniques described above.

Solution to Problems

The present invention provides a process for producing a cleaning sheet, comprising:

superposing a fibrous web containing fibers comprising polyethylene terephthalate on one side or both sides of a net-form sheet;

water needling the fibrous web to entangle the fibers of the fibrous web with each other, and also to entangle the fibers of the fibrous web with the net-form sheet thereby forming a laminate;

blowing hot air having a temperature above the glass transition temperature (Tg (° C.)) of the polyethylene terephthalate and below "Tg (° C.)+70° C." to the laminate by through-air technique.

Advantageous Effects of Invention

The present invention can produce a cleaning sheet that is less prone to lose its bulkiness even in high-speed production and that has excellent capabilities in trapping dirt such as dust balls.

DESCRIPTION OF EMBODIMENTS

Figure 1:
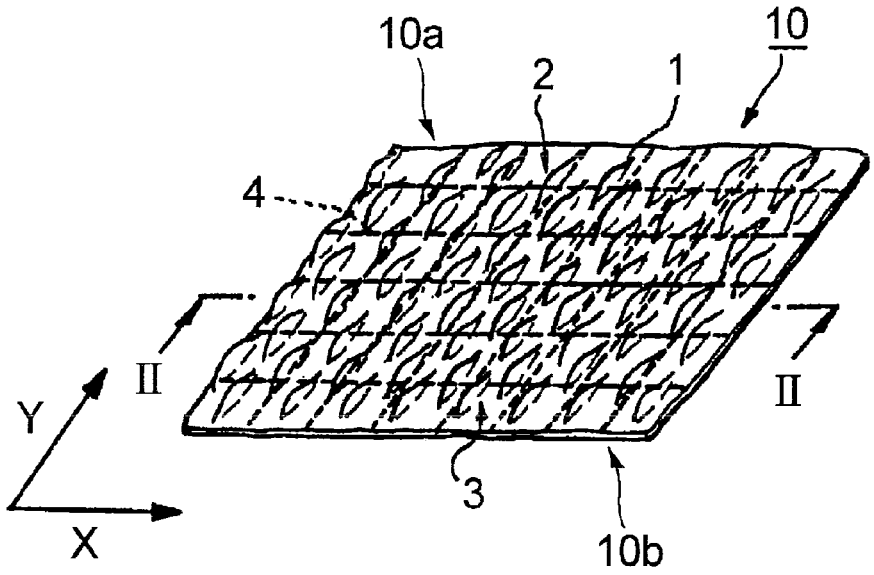
FIG. 1 is a schematic diagram illustrating an example of a cleaning sheet produced according to a production process of the present embodiment.
Figure 2:
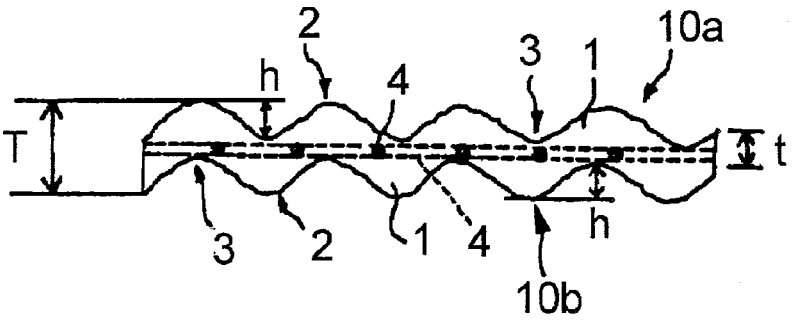
FIG. 2 is an enlarged cross-sectional view illustrating a cross-section taken along line A-A of FIG. 1.

The present invention will be described below according to preferred embodiments thereof with reference to the drawings. First, we will describe a preferred embodiment of a cleaning sheet produced according to a production process of the present invention. As illustrated in FIGS. 1 and 2, a cleaning sheet 10 is composed of a fiber aggregate 1 made by water needling of a fibrous web, and a net-form sheet 4 disposed in the fiber aggregate 1. The constituent fibers of the fiber aggregate 1 and the net-form sheet 4 are entangled through water needling, and thereby the fiber aggregate 1 and the net-form sheet 4 are integrated together, as will be described in detail further below.

As illustrated in FIGS. 1 and 2, the cleaning sheet 10 has a first side 10*a* and a second side 10*b*, and also has a multitude of projections 2, 2 formed to protrude from one side toward the other. Between adjacent projections 2, 2 are formed respective depressions 3, 3, thereby rendering projecting-and-depressed shapes to the entire sheet.

As illustrated in FIG. 1, the projections 2, 2 all have substantially the same size and are shaped like rather elongated, narrow mountains provided at regular intervals. The interval between adjacent projections 2, 2 is preferably 1 to 10 mm, more preferably 1 to 7 mm, in the sheet's width direction (X direction in FIG. 1; the cross direction (CD) in the present embodiment), and is preferably 4 to 20 mm, more preferably 4 to 15 mm, in the sheet's length direction (Y direction in FIG. 1; the machine direction (MD) in the present embodiment). Some of the projections 2 may be connected in the sheet's width direction and/or length direction to form a continuous projection. Providing the projections 2 at the above-described intervals can make the feel of the sheet 10 favorable to the touch, achieve excellent dirt cleaning properties with respect to grooves of wooden floors and uneven surfaces, and also achieve excellent capabilities of trapping and retaining relatively large dirt such as bread crumbs.

Preferably, both sides of the cleaning sheet 10 have similar properties/capabilities, and the shapes and intervals of the projections 2 on the second side 10*b* are preferably substantially the same as those of the first side 10*a*. Particularly, the total area of the projections 2 on the second side 10*b* is preferably 20 to 100%, more preferably 35 to 100%, with respect to the total area of the projections 2 on the first side 10*a*. Preferably, the projections 2 on the first side of the cleaning sheet 10 are in an inside-outside relationship with the depressions 3 in the second side of the sheet 10, and the projection 2 preferably has the inverted shape of the depression 3.

The projections 2 and the depressions 3 consist of the fiber aggregate 1 and are formed by merely entangling the constituent fibers of the fiber aggregate 1. Thus, the projections 2 and the depressions 3 are pleasant to the touch and have excellent capabilities of trapping and retaining dirt such as strands of hair and small particles of dust, in contract to projections formed by fusion-bonding caused by partially heating and pressurizing fibers consisting of thermoplastic resin through embossing etc.

The projections 2 and the depressions 3 of the cleaning sheet 10 are formed by rearranging and re-entangling the constituent fibers of the fiber aggregate 1 which is caused by the water needling process applied thereto; thus, the projections 2 and the depressions 3 can retain their shapes by themselves. Accordingly, the projections 2 and the depressions 3 are less prone to collapse due to load. Owing to the existence of the projections 2 and depressions 3, the apparent thickness of the cleaning sheet 10 becomes larger than the thickness of the fiber aggregate 1 before being provided with the projections 2 and depressions 3. The cleaning sheet 10, with its projections 2 and depressions 3 having good shape-retainability, has excellent properties of cleaning grooves and uneven surfaces as well as excellent capabilities to trap and retain dirt such as bread crumbs.

When the shape-retainability of the projection 2 is evaluated as the difference between the sheet's apparent thickness (initial thickness; thickness under a load of 15 gf/25 $cm^2$ [=59 Pa]) and the apparent thickness under load during cleaning (loaded thickness; thickness under a load of 96 gf/25 $cm^2$ [=376 Pa]), it is preferable that the projections 2 and depressions 3 retain their shapes even when loaded and that the amount of change in thickness is 1 mm or less, more preferably 0.8 mm or less.

In the present invention, the expression "form by rearranging and re-entangling fibers" means that a fiber aggregate, which has once been weakly entangled together through water needling, is again subjected to water needling, this time on a patterning member having a multitude of projecting-and-depressed sections or a multitude of openings, such that the fibers are rearranged along the projecting-and-depressed sections and then entangled again.

As illustrated in FIG. 2, the projections 2 and depressions 3 are formed by rendering a zigzag form to the fiber aggregate 1 in its thickness direction. The multitude of bent sections formed in the zigzag fiber aggregate 1 correspond to the respective projections 2 and depressions 3. As described above, the projections 2 and depressions 3 are formed by rearrangement of the fibers; in doing so, distribution of fibers, which is caused by the high-pressure water pressing the constituent fibers of the projections 2 so that they drift toward the depressions 3, is kept extremely small. Note that distributing the fibers to a greater extent will result in holes being formed in positions where the projections 2 should have existed. The cleaning sheet 10 structured as above has largely projecting-and-depressed shapes despite its low basis weight. The zigzags of the fiber aggregate 1 may be formed either along the machine direction (MD) or the width direction (cross direction; CD). The fiber aggregate 1 can be rendered the zigzag form, without giving rise to distribution of fibers, simply by, for example, setting the energy applied during the water needling process to the values described further below. As to the degree of bending of the cleaning sheet 10, the bending ratio is as high as 2 to 15%, more preferably 3 to 15%. Note that the "bending ratio" is measured according to the procedure described on column 12, line 51 through column 13, line 6 of U.S. Pat. No. 6,936,333 B2, the disclosure of which is incorporated herein by reference.

Preferably, there are, on average, 50 to 850, more preferably 100 to 600, of projections 2 per a 10-by-10-centimeter area on one side of the cleaning sheet 10 at any location of that side. Keeping the number of projections 2 within the above-described range allows the projections 2 and depressions 3 to be arranged in good balance, thus achieving even better capabilities of trapping and retaining small particles of dirt and also even better capabilities of trapping and retaining relatively-large dirt such as bread crumbs.

The apparent specific volume of the cleaning sheet 10 is preferably 23 to 100 $cm^3/g$, more preferably 25 to 90 $cm^3/g$, and even more preferably 30 to 80 $cm^3/g$. An apparent specific volume of 23 $cm^3/g$ or above allows the sheet to sufficiently conform to grooves and uneven surfaces and trap dirt. Further, an apparent specific volume of 100 $cm^3/g$ or less makes the inter-fiber distance appropriate, thus allowing the sheet to retain dirt securely. The value of the apparent specific volume is defined as a quotient found by dividing the value of the apparent thickness (described later) by the basis weight of the fiber aggregate (for a sheet entangled and integrated with a net-form sheet, the basis weight excluding the net-form sheet).

Preferably, the cleaning sheet 10 has an apparent specific volume under load during cleaning of 18 $cm^2/g$ or above, and more preferably 20 $cm^2/g$ or above, with a maximum of 100 $cm^2/g$.

As illustrated in FIG. 2, the cleaning sheet 10 has an apparent thickness T (thickness between the uppermost section of the first side 10*a* and the lowermost section of the second side 10*b*) that is thicker than the thickness t of the fiber aggregate 1 itself, and is thus extremely bulky. The value of the apparent thickness T of the cleaning sheet 10 is preferably 1 to 5 mm, and more preferably 1.4 to 4 mm, from the standpoint of forming enough voids in the sheet to make the sheet bulky and allowing the sheet to be suitably used as a cleaning sheet, for example. The value of the thickness t of the fiber aggregate 1 itself is determined depending on the basis weight and processing conditions of the fiber aggregate 1, and is preferably 0.5 to 4 mm, more preferably 1 to 3 mm. Further, the height h of the projection as illustrated in FIG. 2 is preferably 0.2 mm to 4 mm, more preferably 0.5 mm to 4 mm. The thickness t of the fiber aggregate 1 itself is measured by observing the cross-section of the cleaning sheet 10 under a load of 15 gf/25 $cm^2$ (=59 Pa) with an optical microscope.

The elongation of the cleaning sheet 10 in its machine direction (MD) is preferably 5% or less, and more preferably 4% or less, under the condition that a load of 5 N is applied to a 30-mm-wide sample. Such an elongation is preferable in terms of preventing deformation of the projections 2 and depressions 3 caused by pulling and stretching of the cleaning sheet 10 during production or during use of the cleaning sheet 10, to thus prevent reduction in bulkiness of the cleaning sheet 10.

The "elongation" in the machine direction is measured as follows. A sample 30-mm wide in a direction orthogonal to the machine direction is cut out from the cleaning sheet 10. The sample is then held in a tensile tester at a chuck-to-chuck distance of 100 mm, and the sample is pulled in the machine direction at a speed of 300 mm/min. The "elongation" is found by dividing the sample's elongation amount at a tensile load of 5 N by the initial sample length (100 mm) and multiplying the quotient by 100.

Next, the fiber aggregate 1 and the net-form sheet 4 constituting the cleaning sheet 10 will be described. The fiber aggregate 1 is a nonwoven-like article formed by entangling the constituent fibers of a fibrous web together by applying water needling thereto. The fiber aggregate 1 is formed by merely entangling its constituent fibers, and therefore, the degree of freedom of the constituent fibers is high compared to a web made by simply fusing or bonding the constituent fibers. Thus, the fiber aggregate 1 has excellent capabilities to trap and retain dirt, such as strands of hair and small particles of dust, with its constituent fibers, and also has a pleasant feel to the touch.

In the present embodiment, the fibers that are used to constitute the fiber aggregate 1 contain polyethylene terephthalate (PET). The use of fibers containing PET is advantageous in that the cleaning sheet 10 becomes extremely bulky by being subjected to hot-air processing during the production process described further below. Examples of fibers containing PET include: a single fiber consisting only of PET; a single fiber consisting of a blend of PET and another thermoplastic resin; and a conjugate fiber containing PET. Examples of usable conjugate fibers include: core/sheath conjugate fibers employing PET as, for example, the core component; and side-by-side conjugate fibers in which PET constitutes one of the components. It is preferable to use a single fiber consisting only of PET in order to effectively make the cleaning sheet 10 bulky through the hot-air processing.

It is preferable to use PET having a weight-average molecular weight of 5,000 to 100,000, more preferably 8,000 to 50,000, from the standpoint of rendering the cleaning sheet 10 bulky through hot-air processing.

The fiber aggregate 1 may consist only of the fibers containing PET, or may contain other fibers in addition to the PET-containing fibers. Examples usable as other fibers are described, for example, on column 4, lines 3 to 10 of U.S. Pat. No. 5,525,397 A, the disclosure of which is incorporated herein by reference. In cases where the fiber aggregate 1 contains other fibers, the amount of fibers containing PET is preferably 40% by weight or more, more preferably 50% by weight or more, with respect to the weight of the fiber aggregate 1, whereas the amount of the other fibers is preferably less than 60% by weight, more preferably less than 50% by weight, with respect to the weight of the fiber aggregate 1. Preferably, the fiber aggregate 1 consists only of fibers containing PET in order to effectively make the cleaning sheet 10 bulky through the hot-air processing.

The thickness of the fiber containing PET is not particularly critical in terms of the bulkiness of the cleaning sheet 10 rendered by the hot-air processing. From the standpoint of the capabilities to trap and retain strands of hair and dirt, the thickness of the fiber containing PET is preferably 0.05 to 100 dtex, more preferably 0.5 to 20 dtex.

The basis weight of the fiber aggregate 1 and the fiber length of its constituent fibers are determined with comprehensive consideration given to processability, cost, etc. The basis weight of the fiber aggregate 1 is preferably 30 to 100 $g/m^2$, more preferably 40 to 70 $g/m^2$. The fiber length of the constituent fiber is preferably 20 to 100 mm, more preferably 30 to 65 mm, in terms of preventing holes from being formed in the cleaning sheet 10 as well as rendering and sustaining sufficient bulkiness.

The cleaning sheet 10 has a net-form sheet 4 disposed in the fiber aggregate 1, as described above. As illustrated in FIG. 1, the net-form sheet 4 is a resinous net shaped like a grid as a whole. The net-form sheet 4 preferably has an air permeance of 0.1 to 1000 $cm^3/(cm^2 \cdot sec)$. Materials other than a net, such as a nonwoven fabric, paper, or a film, may be used as the net-form sheet 4 as long as the air permeance is within the above-described range. Not only are the constituent fibers of the fiber aggregate 1 entangled together, but also the constituent fibers of the fiber aggregate 1 are entangled with the net-form sheet 4, thus improving the tensile strength. The thread diameter of the net-form sheet 4 is preferably 50 to 600 μm, more preferably 100 to 400 μm. The distance between adjacent threads is preferably 2 to 30 mm, more preferably 4 to 20 mm. Materials usable as the constituent material of the net-form sheet 4 are described, for example, on column 3, lines 39 to 46 of U.S. Pat. No. 5,525,397 A, the disclosure of which is incorporated herein by reference. The constituent material of the net-form sheet 4 may be heat-shrinkable. By applying heat processing at the time of producing cleaning sheets, heat-shrinkable materials can provide cleaning sheets having increased apparent thickness T and sharply-shaped projections. It is, however, preferable that the net-form sheet 4 is not heat-shrunk, or in cases where it is heat-shrunk, the heat-shrinkage rate after being heated for 3 minutes at 140° C. is preferably 3% or less.

The basis weight of the cleaning sheet 10 is preferably 30 to 110 $g/m^2$, more preferably 38 to 80 $g/m^2$, and even more preferably 45 to 80 $g/m^2$, in terms of providing a suitable thickness to the sheet and improving processability. The breaking strength for a 30-mm-wide sample is preferably 5 N or above, more preferably 7 N or above, from the standpoint of providing a sheet strong enough to endure use. The breaking strength need only be within the above-described range in at least one direction of the cleaning sheet 10; preferably, the breaking strength is within the above-described range in the width direction (cross direction; CD) which is most difficult to make strong. The maximum breaking strength is around 20 N in terms of practical use.

The breaking strength is measured as follows. A sample 30-mm wide in a direction orthogonal to the sheet's fiber-orientation direction is cut out. The sample is then held in a tensile tester at a chuck-to-chuck distance of 100 mm, and the sample is pulled in the direction orthogonal to the fiber-orientation direction at a speed of 300 mm/min. The load value at which the sheet starts to tear (the first peak value appearing in the continuous curve obtained through this measurement) is taken as the "breaking strength".

Next, a preferred process for producing the above-described cleaning sheet will be described with reference to FIGS. 3 and 4. The process for producing the cleaning sheet 10 of the present embodiment includes, in the following order: a superposing step of superposing an upper-layer fibrous web 1*a* and a lower-layer fibrous web 1*b* on the respective sides of a net-form sheet 4; an entangling step of entangling, through water needling, the constituent fibers of the fibrous webs 1*a* and 1*b* together to form a fiber aggregate, and also entangling the constituent fibers of the fibrous webs 1*a* and 1*b* and the net-form sheet 4 together to form a laminate 6 in which the fibrous webs and the net-form sheet have been integrated; and a projection-and-depression applying step of carrying the laminate 6 onto a patterning member having a multitude of projecting-and-depressed sections and making some portions of the fiber aggregate protrude into the depressed sections, so as to form a multitude of projections corresponding to the depressed sections. Thereafter, a hot-air blowing step is conducted.

Figure 3:
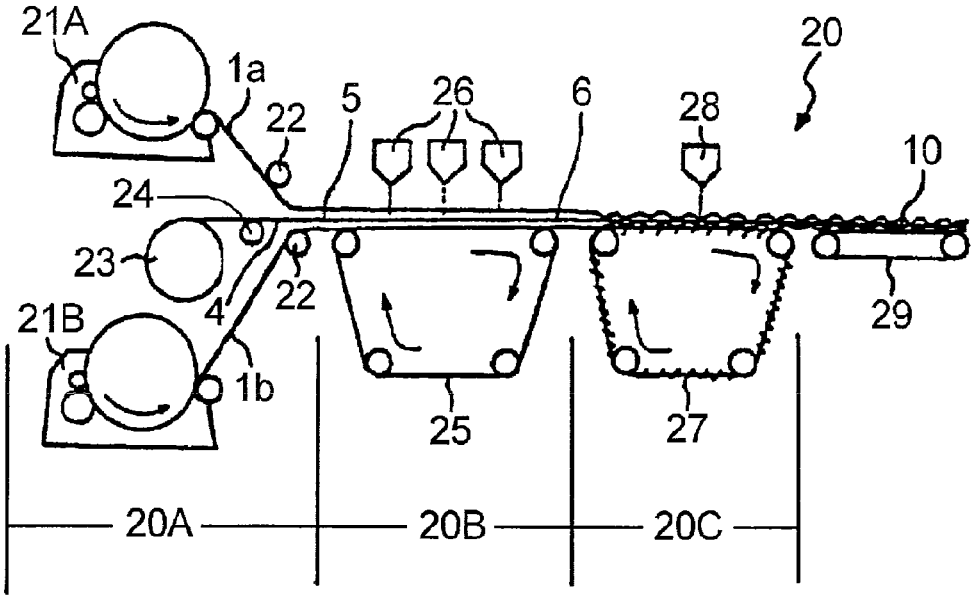
FIG. 3 is a schematic diagram of a production device suitably used for the production process of the present invention

FIG. 3 illustrates a production device 20 preferably used for the process of producing the cleaning sheet 10. The production device 20 can roughly be divided into a superposing section 20A, an entangling section 20B, and a projection-and-depression applying section 20C. The superposing section 20A includes: carding machines 21A and 21B for respectively producing the fibrous webs 1*a* and 1*b*; paying-out rolls 22, 22 for paying out the fibrous webs 1*a* and 1*b*; and a roll 24 for paying out the net-form sheet. The entangling section 20B includes a web-supporting belt 25 consisting of an endless belt; and first water-jet nozzles 26.

The projection-and-depression applying section 20C includes: a patterning member 27 consisting of an endless belt; and second water-jet nozzles 28. The patterning member 27 rotates in the direction illustrated by the arrows in FIG. 3. The patterning member 27 is liquid-permeable and has a multitude of projecting-and-depressed sections on its surface. Details thereof are described on column 8, line 23 through column 9, line 19 and FIGS. 4(a) and (b) of U.S. Pat. No. 6,936,333 B2, the disclosure of which is incorporated herein by reference. After the projection-and-depression applying section 20C comes a carrying belt 29. Preferably, the patterning member 27 has some degree of thickness, and more specifically, the thickness is preferably 5 to 25 mm, more preferably 5 to 15 mm, in terms of applying a sufficiently large bulkiness and in terms of energy efficiency at the time of applying the projections and depressions. For the same reason, the air permeance of the patterning member 27 is preferably 800 to 3000 $cm^3/(cm^2 \cdot sec)$, more preferably 800 to 2000 $cm^3/(cm^2 \cdot sec)$.

In the device 20 for producing the cleaning sheet 10 structured as above, first, the carding machines 21A and 21B in the superposing section 20A respectively pay out the fibrous webs 1*a* and 1*b* continuously via the paying-out rolls 22, 22. Preferably, at least one of the fibrous webs 1*a* and 1*b* contains 40% by weight or more of fibers containing polyethylene terephthalate. A roll 23 of net-form sheet 4 is disposed between the carding machines 21A and 21B, and the paying-out roll 24 for the roll 23 pays out the net-form sheet 4. At the positions of the paying-out rolls 22, 22, the fibrous webs 1*a* and 1*b* are superposed on the respective sides of the net-form sheet 4, to form a superposed element 5. Preferably, at least one of the fibrous webs 1*a* and 1*b* contains 40% by weight or more of fibers containing PET. More preferably, both the fibrous webs 1*a* and 1*b* contain 40% by weight or more of fibers containing PET, and even more preferably, both the fibrous webs 1*a* and 1*b* consist of 100% of fibers containing PET.

In the entangling section 20B, the superposed element 5 transported and carried on the web-supporting belt 25 is subjected to entangling processing by high-pressure jet streams of water emitted from the first water-jet nozzles 26. As a result, the constituent fibers of the fibrous webs 1*a* and 1*b* in the superposed element 5 are entangled together to form a fiber aggregate, and also, the constituent fibers and the net-form sheet 4 are entangled together, to form a laminate 6 in which the fibrous webs and the net-form sheet have been integrated together. Preferably, the fibers constituting the fiber aggregate in the laminate 6 have a low degree of entanglement. The degree of entanglement, as expressed by "entanglement coefficient", is preferably 0.05 to 2 N·m/g, more preferably 0.2 to 1.2 N·m/g. Controlling the degree of entanglement of the fibers constituting the fiber aggregate in the laminate to fall within the above-described range allows production of a cleaning sheet having clear projecting-and-depressed shapes, without giving rise to any holes, at the time of applying projections and depressions in the projection-and-depression applying section 20C described below.

The "entanglement coefficient" is a measure indicating the degree of entanglement among constituent fibers, and is represented by the initial gradient of the stress-strain curve measured in a direction perpendicular to the fiber orientation direction of the fiber aggregate 1 of the integrated laminate 6; the smaller the coefficient, the weaker the entanglement among the fibers. Here, the "fiber orientation" is in the direction in which the maximum point-load value in a tensile-strength test becomes the largest; the "stress" is the quotient found by dividing the tensile load by the "clamping width" (width of the specimen in the tensile-strength test) and by the basis weight of the fiber aggregate 1; and the "strain" refers to the elongation amount. A concrete example for measuring the entanglement coefficient is described on column 12, lines 32 to 50 of U.S. Pat. No. 6,936,333 B2, the disclosure of which is incorporated herein by reference.

Then, in the projection-and-depression applying section 20C, the laminate 6 is transported onto the patterning member 27 and carried thereby. While being carried, the laminate 6 is partially pressurized by high-pressure jet streams of water emitted from the second water-jet nozzles 28. At this time, portions of the laminate 6 that are located on the depressed sections of the patterning member 27 are pressurized, and the pressurized portions thus protrude into the depressed sections. As a result, the pressurized portions are formed into depressions 3 corresponding to the depressed sections. On the other hand, portions of the laminate 6 that are located on the projecting sections of the patterning member 27 are not made to protrude, and thus become the projections 2. In this way, a multitude of projections 2, 2—as well as the depressions 3 between the projections 2, 2—are formed on the laminate 6, thus applying projecting-and-depressed shapes over the entire laminate 6. The features, such as the shape, of the projections 2 are determined depending on such factors as the type of the patterning member 27 and the entangling energy applied to the fiber aggregate by the high-pressure jet streams of water in the entangling section 20B and the projection-and-depression applying section 20C. The entangling energy, in turn, can be controlled according to such conditions as the nozzle shape of the water-jet nozzles, the nozzle pitch, water pressure, number of stages (pieces) of nozzles, and line speed.

Assuming that "Em" represents the energy applied at the time of water needling the fibrous webs to form the fiber aggregate 1 and "Ef" represents the energy applied at the time of making some portions of the fiber aggregate 1 protrude on the patterning member 27, it is preferable that, in the present production process, the energy applied satisfies the condition(s) 200 (kJ/kg)<Em+Ef<1250 (kJ/kg), more preferably 400 (kJ/kg)<Em+Ef<1000 (kJ/kg), and/or, Em/10<Ef<2Em/3, more preferably Em/4<Ef<3Em/5 from the standpoint of providing sufficient bulkiness, preventing fibers from falling off and holes from opening during projection-and-depression formation, and developing a sufficient sheet strength. "Em" and "Ef" are each calculated from the following equation:

$$\text{Energy}(\text{“}Em\text{” or “}Ef\text{”})\ (\text{kJ/kg}) = \frac{n\rho v^2 Ca}{2VB}\sqrt{\frac{2P}{\rho}} \qquad \text{[Math. 1]}$$

wherein:

n represents the number of outlets per meter in nozzle's width direction;

ρ represents the water density (kg/m$^3$);

v represents the water flow rate (m/sec) at the nozzle tip;

C represents the flow coefficient due to energy loss (0.592 to 0.68 in case of water);

a represents the cross-sectional area (m$^2$) at the nozzle tip;

V represents the web processing speed (m/sec);

B represents the web's basis weight (g/m$^2$); and

P represents the water pressure (Pa) inside the nozzle.

Figure 4:
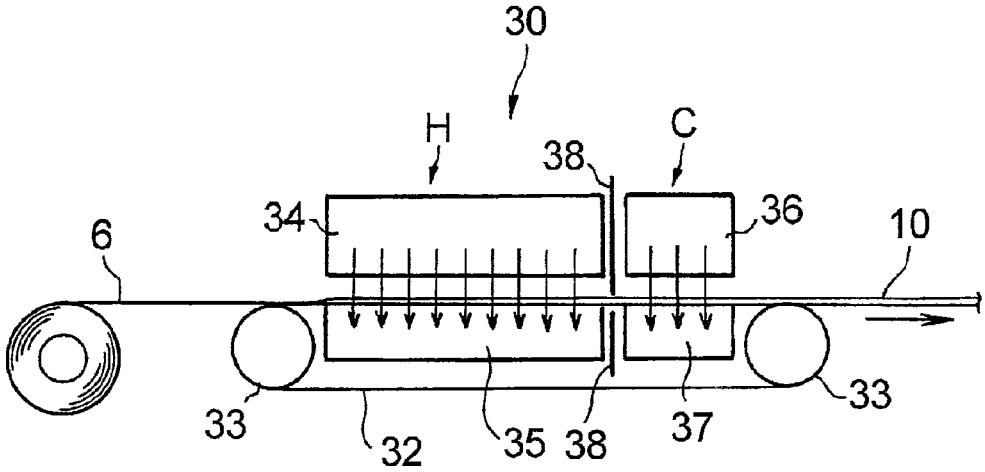
FIG. 4 is a schematic diagram of a production device suitably used for the production process of the present invention.

The laminate 6 provided with the projecting-and-depressed shapes is then carried to a hot-air processing device 30 illustrated in FIG. 4. At that time, the laminate 6 may once be wound into a roll, and then the laminate 6 may be unwound from the roll to be carried into the hot-air processing device 30. Alternatively, the laminate 6 produced by the device 20 illustrated in FIG. 3 may be directly carried into the hot-air processing device 30, without being wound into a roll. It is, however, preferable to once wind the laminate 6 into a roll and then pay it out from the roll to undergo hot-air processing, because the bulkiness-restoring effect becomes more significant. Note that the laminate 6 provided with the projecting-and-depressed shapes is subjected to drying by such means as hot air, regardless of whether it is once wound into a roll or not. The drying process is applied to the sheet manufactured through water needling by employing commonly-used devices and conditions (omitted from drawings). Preferably, the drying temperature is below the melting point of the component having the lowest melting point among the constituent fibers of the laminate 6.

The device 30 illustrated in FIG. 4 includes: a wire-mesh conveyer belt 32; a heating zone H; and a cooling zone C. The conveyer belt 32 is an endless belt supported by a pair of support shafts 33, 33 and rotating in a predetermined direction. The heating zone H is provided on the upstream side relative to the rotating direction of the conveyer belt 32, whereas the cooling zone C is provided on the downstream side relative thereto. The conveyer belt 32 is made of metal and/or a resin such as polyethylene terephthalate. Preferably, the conveyer belt 32 is made of a resin such as polyethylene terephthalate from the standpoint of heat-radiation efficiency in the heating zone H and the cooling zone C.

A first blower 34 is disposed above and in opposition to the conveyer belt 32. The first blower 34 blows, toward the conveyer belt 32, hot air heated to a predetermined temperature. A first suction box 35 is disposed in opposition to the first blower 34 across the conveyer belt 32, for suction of the hot air blown from the first blower 34. The first blower 34 and the first suction box 35 constitute the heating zone H. The hot air sucked in by the first suction box 35 is fed into the first blower 34 through a duct (not shown). In other words, the hot air circulates between the first blower 34 and the first suction box 35.

A second blower 36 is disposed in opposition to the conveyer belt 32 and immediately downstream of the first blower 34 relative to the rotating direction of the conveyer belt 32. The second blower 36 blows, toward the conveyer belt 32, cool air at a predetermined temperature. A second suction box 37 is disposed in opposition to the second blower 36 across the conveyer belt 32, for suction of the cool air blown from the second blower 36. The second blower 36 and the second suction box 37 constitute the cooling zone C. The cool air sucked by the second suction box 37 is discharged outside the device through a duct (not shown). In other words, in contrast to the hot air in the heating zone H, the cool air is not circulated between the second blower 36 and the second suction box 37. This is done in order to prevent heating of the cool air due to circulation and increase the efficiency for cooling the laminate 6.

Partitioning plates 38, 38 are disposed between the first blower 34 and the second blower 36 and between the first suction box 35 and the second suction box 37, respectively. The partitioning plates 38 prevent the hot air and the cool air from mixing together.

In the embodiment of FIG. 4, a rolled-up laminate 6 produced by the device 20 illustrated in FIG. 3 is arranged upstream of the first blower 34 of the device 30, and the laminate 6 is paid out from the roll. Because the laminate 6 is wrapped into a roll, its bulkiness is reduced due to the roll-up pressure. The bulkiness of this rolled-up laminate 6 is restored by passing it through the device 30.

First, the laminate 6 is carried along with the conveyer belt 32, and the carried laminate 6 is sent into the heating zone H, where the first blower 34 blows, toward the conveyer belt 32, hot air heated to a predetermined temperature. In the heating zone H, the hot air is blown to the laminate 6 by through-air technique. That is, the hot air is blown to the laminate 6 and then passes through the laminate 6. The present Inventors have found through investigation that, surprisingly, this hot-air blowing operation serves to increase the bulkiness of the laminate 6, which is in a bulkiness-reduced state, and to restore its bulkiness back to the same degree as before roll-up. Particularly, it was also found that the presence of the net-form sheet 4 in the laminate 6 significantly heightens the degree of increase in bulkiness.

The hot air to be blown to the laminate 6 should be adjusted to a temperature above the glass transition temperature (Tg (° C.)) of PET in the PET-containing fibers of the laminate and below "Tg (° C.)+70° C.". In cases where the temperature of the hot air is equal to or below Tg (° C.), the effect of blowing the hot air will not be achieved sufficiently and the bulkiness of the laminate 6 will not be restored. On the other hand, blowing hot air at temperatures equal to or above "Tg (° C.)+70° C." will cause the fibers to melt, and thus in this case also, the bulkiness of the laminate 6 will not be restored. From the standpoint of restoring the bulkiness of the laminate 6 even more effectively, the temperature of the hot air is preferable equal to or above 80° C. and equal to or below 140° C., and more preferably equal to or above 85° C. and equal to or below 135° C. It is also preferable that the temperature of the hot air to be blown is below the melting point of the resin constituting the net-form sheet 4.

The above-described glass transition temperature Tg is measured using a differential scanning calorimeter (DSC). The measurement using the DSC is conducted in a nitrogen atmosphere at a temperature-increase rate of 10° C./min. "Tg" is defined as the temperature where a step is observed on the lower-temperature side than the temperature of the endothermic peak in the endothermic curve obtained during the first temperature increase.

The time for which the hot air is blowen is not a critical element in terms of bulkiness restoring, and a short period of time will be sufficient. More specifically, the bulkiness of the laminate 6 will be restored in an extremely short hot-air-blowing time as short as preferably 0.05 to 3 seconds, more preferably 0.05 to 1 second, and even more preferably 0.05 to 0.5 seconds. This contributes to an improvement in production efficiency and downsizing of the device 30. It is thought that through-air technique contributes greatly to the short blowing time. Constant-temperature drying ovens and driers may be considered as other usable means for applying heat to the laminate 6 besides blowing hot air by through-air technique, but these blowing methods cannot achieve bulkiness restoration in such a short time.

The speed at which to blow the hot air is preferably 0.5 to 10 msec, more preferably 1 to 5 m/sec, in terms of hot-air cost and downsizing of the device, although the speed depends on the temperature of the hot air, the basis weight of the laminate 6, and the carrying speed.

The above-described operation restores the bulkiness of the laminate 6 to around 1.2 to 3 times the bulkiness before blowing hot air (i.e., the bulkiness before blowing hot air becomes 1/1.2 to ⅓ of the bulkiness after blowing hot air), thus achieving the intended cleaning sheet. The thickness of the laminate 6 is restored to around 50 to 100% of the thickness before being wound around a roll.

The present Inventors have found through investigation that rolling-up the cleaning sheet 10, whose bulkiness has been restored by blowing hot air, may again reduce the restored bulkiness of the cleaning sheet 10. The Inventors also found that, to prevent this, it is effective to blow cool air onto the cleaning sheet 10 by through-air technique immediately after the bulkiness of the cleaning sheet 10 has been restored by blowing hot air. Blowing cool air cools the bulky cleaning sheet 10 so that its bulkiness is sustained, and this prevents the bulkiness from being reduced even when the sheet is wound into a roll shape. Accordingly, in the device 30 illustrated in FIG. 4, the cooling zone C is disposed adjacent to and immediately downstream of the heating zone H in the carrying direction of the cleaning sheet 10. The expression "blow cool air onto the cleaning sheet 10 immediately after the bulkiness of the cleaning sheet 10 has been restored by blowing hot air" means that there is no operation between the step of blowing hot air onto the cleaning sheet 10 and the subsequent step of blowing cool air, and does not intend to mean that there is no time difference between the hot-air blowing and cool-air blowing.

In the cooling zone C, cool air at a predetermined temperature is blown from the second blower 36 toward the conveyer belt 32. The cool air is blown by through-air technique onto the cleaning sheet 10 in the cooling zone C. In other words, in the cooling zone C, the cool air is blown onto the cleaning sheet 10 and then passes through the cleaning sheet 10.

A sufficient cooling effect can be achieved at a cool-air temperature of 50° C. or below, more preferably 30° C. or below, although this may depend on the type of fiber constituting the nonwoven fabric. There is no particular lower limit to the cool-air temperature, but room temperature around 20 to 25° C. is suitable in terms of energy cost and simplification of the device 30.

The speed at which to blow the cool air is preferably 1 to 10 msec, more preferably 1 to 5 m/sec, and even more preferably 1 to 3 msec, from the standpoint of sufficiently cooling the cleaning sheet 10 which is hot due to blowing of hot air. A wind speed within the above-described range will achieve a sufficient cooling effect. It is also possible to reduce the possibility of inhibiting stable carrying of the cleaning sheet 10 due to high wind speed.

The present Inventors have found through investigation that only a short amount of time is required for blowing the cool air, as with the amount of time for which the hot air is blown. More specifically, the cleaning sheet 10 will be sufficiently cooled in an extremely short cool-air-blowing time as short as 0.01 second or longer, more preferably 0.02 to 1 second, and even more preferably 0.05 to 0.5 seconds. It is thought that through-air technique contributes greatly to the short blowing time.

In cases where the cleaning sheet 10 contains heat-shrinkable fibers, the sheet 10 may shrink due to the hot air blown thereon in the heating zone H. Shrinking is prone to occur particularly in the width direction of the sheet 10, i.e., in the direction orthogonal to the carrying direction of the sheet 10. To prevent this, it is preferable to suppress the sheet from shrinking in its width direction such that the width of the cleaning sheet 10 after blowing cool air (i.e., the width of the cleaning sheet 10 after leaving the cooling zone C) is 95% or above, more preferably 97% or above, with respect to the width of the laminate 6 before blowing hot air thereon (i.e., the width of the laminate 6 before entering the heating zone H). One way to suppress shrinking is to grip both sides of the laminate 6 along the carrying direction with predetermined gripping means so that the width of the laminate 6 will not change, and send the laminate 6 into the heating zone H and the cooling zone C in this gripped state. Another very simple way may be to adjust the wind speed of the hot air and cool air so as to press the laminate 6 against the conveyer belt 32 at the time of blowing the hot air and cool air onto the laminate 6 respectively in the heating zone H and the cooling zone C, and carry the laminate 6 in such a state that its width does not change. The range of the wind speed of the hot air and cool air is as described above; the wind speed may be determined within the above-described range depending on the basis weight of the laminate 6 and the carrying speed.

By undergoing the above operations, the cleaning sheet 10 becomes very bulky. The bulky cleaning sheet 10 then undergoes various subsequent processing steps. Examples of such processing steps include a step of cutting the cleaning sheet 10 into a multitude of individual sheets, a step of placing several pieces of the cut-up cleaning sheets 10 on top of one another and putting them in a packing bag, and so forth. The cleaning sheets 10 obtained may be used as dry cleaning sheets, or as wet cleaning sheets impregnated with various cleaning agents.

The present invention has been described in detail above according to a preferred embodiment thereof. The present invention, however, is not to be limited thereto. For example, in the above production process, fibrous webs 1*a* and 1*b* were disposed on respective sides of the net-form sheet 4; instead a fibrous web may be disposed only on one side of the net-form sheet 4. In that case, the fibrous web preferably contains 40% by weight or more of fibers containing polyethylene terephthalate.

Further, in the foregoing embodiment, the hot-air processing using the device 30 was followed by cool-air processing; however, the cool-air processing is not always necessary.

EXAMPLES

The present invention will be described in further detail below according to Examples thereof. The scope of the present invention, however, is not to be limited to these Examples. Unless otherwise stated, "%" and "parts" refer respectively to "% by weight" and "part by weight".

Example 1

PET fiber (1.45 dtex; 38 mm; Tg: 78° C.; weight-average molecular weight: 20,000) was employed as the starting material and was made into a fibrous web having a basis weight of 24 g/m$^2$ by an ordinary carding method. A polypropylene grid-shaped net (inter-fiber distance: 8 mm; thread diameter: 300 μm) was used as the net-form sheet. The above-described fibrous webs were superposed on respective sides of the net-form sheet. Then, the fibrous webs and the net-form sheet were entangled and integrated together by jet streams of water emitted from the plurality of nozzles illustrated in FIG. 3 under water-pressure conditions of 1 to 5 MPa, to thus obtain a laminate including a fiber aggregate having an entanglement coefficient of 0.5 N·m/g. The applied energy Em was 295 kJ/kg. Next, the laminate was subjected to jet streams of water emitted from a plurality of nozzles under water-pressure conditions of 1 to 5 MPa on a patterning member, so as to provide the laminate with projecting shapes. The shaped laminate was then dried with hot air, to thus obtain a laminate having projecting-and-depressed shapes, as illustrated in FIGS. 1 and 2. The applied energy Ef was 175 kJ/kg. The patterning member used was structured as described in FIGS. 4(a) and (b) of U.S. Pat. No. 6,936,333 B2, the disclosure of which is incorporated herein by reference.

The thus-obtained laminate was once wound into a roll. Then, the laminate was unwound from the roll and carried to the device 30 illustrated in FIG. 4. The pay-out speed was 150 m/min, a speed suitable for high-speed production. Hot air at the temperature shown in Table 1 was blown onto the laminate at a wind speed of 3 m/sec by through-air technique. After the hot-air blowing process, the laminate was subjected to natural cooling. In this way, a cleaning sheet was prepared.

Examples 2 and 3 and Comparative Example 1

Respective cleaning sheets were prepared in the same way as in Example 1, except that the respective conditions shown in Table 1 were employed for the hot-air processing.

Comparative Example 2

A cleaning sheet was prepared in the same way as in Example 1, except that a fibrous web having a basis weight of 27 g/m$^2$ was used, and no hot-air processing was conducted.

Evaluation:

For each cleaning sheet prepared according to the Examples and Comparative Examples, the "hair trapping rate" and "thickness" were measured according to the methods described below, and also, the "clarity of projecting-and-depressed shapes in the sheet's cross-section in its thickness direction", the "sheet processability", and the "suitability as a product" were evaluated according to the following criteria. The results are shown in Table 1.

Hair Trapping Rate:

Each cleaning sheet was attached to the head of a "Quickie Wiper" (registered trademark), a cleaning tool manufactured by Kao Corporation. The trapping rate for when the side of the cleaning sheet onto which the jet streams of water were blown during production (referred to hereinafter as "back side") was used as the cleaning surface and also the trapping rate for when the side opposite from the side onto which the jet streams of water were blown (referred to hereinafter as "front side") were measured. A 30-by-60-centimeter wooden floor ("Woody Tile MT613T"; product of Matsushita Electric Works Co., Ltd.) was used as a "normal wooden-floor surface". Ten pieces of hair, each approximately 10 cm long, were scattered on this "normal surface". The cleaning sheet was then placed thereon and moved back-and-forth 5 times at a given stroke (60 cm), and the number of pieces of hair trapped on the cleaning sheet was counted. This operation was repeated 3 times consecutively, and the number of pieces of trapped hair, among the 30 pieces of scattered hair, was counted. The quotient found by dividing the number of pieces of trapped hair by 30 was multiplied by 100, to find the "hair trapping rate (%)". In addition, a 30-by-60-centimeter smooth-finish decorative board was used as a low-friction "smooth surface"; 10 pieces of hair, each approximately 10 cm long, were scattered on this "smooth surface"; the cleaning sheet was then placed thereon and moved back-and-forth twice at a given stroke (60 cm); the number of pieces of hair trapped on the cleaning sheet was counted; and thereafter, the same steps as those for the "normal surface" were performed, to find the "trapping rate".

Sheet Thickness:

The thicknesses at a load of 300 Pa and 700 Pa were measured, respectively.

Clarity of Projecting-and-Depressed Shapes in Sheet's Cross-Section in Thickness Direction:

The sheet's cross-section in its thickness direction was observed with a microscope, to visually evaluate the clarity of the projecting-and-depressed shapes according to the following criteria:

A: Projecting-and-depressed shapes are clear.

C: Some of the projecting-and-depressed shapes are clear.

F: Projecting-and-depressed shapes are unclear, or absolutely no projecting-and-depressed shape is visible.

Sheet Processability:

The following criteria were used to evaluate whether or not the sheet adapted to high-speed processing:

A: Neither shrinkage in the sheet's width direction nor fall-off of fibers from the sheet's surface was observed.

B: Slight shrinkage in the sheet's width direction and slight fall-off of fibers from the sheet's surface were observed.

C: Either the sheet shrank to an extent that affected cutting, or fall-off of fibers from the sheet's surface was clearly observed.

F: The sheet shrank significantly in the width direction, and so many fibers fell off from the sheet's surface that they could be visually observed.

Sheet's Suitability as Product:

A: Stable shape and good texture.

C: The shape was unstable, and the sheet was in such a state that fibers could easily fall off from the sheet's surface.

F: Fall-off of fibers from the sheet's surface was observed, and some areas exhibited extremely different texture from other areas.

TABLE 1

| | Example 1 | | Example 2 | | Example 3 | | Comparative Example 1 | | Comparative Example 2 | |
|---|---|---|---|---|---|---|---|---|---|---|
| | Front Side | Back Side | Front Side | Back Side | Front Side | Back Side | Front Side | Back Side | Front Side | Back Side |
| Basis Weight (g/m$^2$) | 53 | | 53 | | 53 | | 53 | | 58 | |
| Hot Air Temp. (° C.) | 120 | | 90 | | 135 | | 260 | | None | |

TABLE 1-continued

| | | Example 1 | | Example 2 | | Example 3 | | Comparative Example 1 | | Comparative Example 2 | |
|---|---|---|---|---|---|---|---|---|---|---|---|
| | | Front Side | Back Side | Front Side | Back Side | Front Side | Back Side | Front Side | Back Side | Front Side | Back Side |
| Hair Trapping Rate (%) | Normal Surface | 100 | 100 | 100 | 100 | 100 | 90 | . . . *1 | . . . *1 | 100 | 100 |
| | Smooth Surface | 85 | 83 | 82 | 84 | 80 | 70 | . . . *1 | . . . *1 | 73 | 57 |
| Thickness (mm) | 300 Pa | 1.38 | | 1.26 | | 1.4 | | . . . *1 | . . . *1 | 1.1 | |
| | 700 Pa | 1.11 | | 1.03 | | 1.2 | | . . . *1 | . . . *1 | 0.87 | |
| Clarity of Projecting-and-Depressed Shapes | | A | | A | | A | | . . . *1 | | C | |
| Processability | | A | | A | | A | | A | | A | |
| Suitability as Product | | A | | A | | A | | F | | A | |

*1: Measurement impossible due to intense fiber shrinkage.

The results of Table 1 clearly show that the cleaning sheets of the present Examples are superior to the cleaning sheets of the Comparative Examples in terms of bulkiness and hair trapping capabilities.

The invention claim is:

1. A process for producing a cleaning sheet, comprising:

superposing a fibrous web containing fibers comprising polyethylene terephthalate on one side or both sides of a net-form sheet, wherein the net-form sheet comprises polypropylene;

water needling the fibrous web to entangle the fibers of the fibrous web with each other to form a fiber aggregate, and also to entangle the fibers of the fibrous web with the net-form sheet thereby forming a laminate;

blowing hot air to the laminate by through-air technique;

wherein the hot air has a temperature (i) above the glass transition temperature (Tg (° C.)) of the polyethylene terephthalate and below "Tg (° C.) +70° C." and (ii) below the melting point of the polypropylene constituting the net-form sheet; and wherein the fiber aggregate is formed by merely entangling its constituent fibers.

2. The process for producing a cleaning sheet according to claim 1, wherein:

in cases where the fibrous web is superposed on both sides of the net-form sheet, at least one of the fibrous webs includes at least 40% by weight of the fibers containing the polyethylene terephthalate; and in cases where the fibrous web is superposed on one side of the net-form sheet, the fibrous web includes at least 40% by weight of the fibers containing the polyethylene terephthalate.

3. The process for producing a cleaning sheet according to claim 1, wherein:

after preparing the laminate by entangling the fibers of the fibrous web with the net-form sheet, the laminate is dried with hot air; and then hot air is blown to the laminate by through-air technique.

4. The process for producing a cleaning sheet according to claim 3, wherein:

the laminate is once wound into a roll after being dried with hot air; and the laminate is unwound from the roll and then hot air is blown to the laminate by through-air technique.

5. The process for producing a cleaning sheet according to claim 1, wherein the polyethylene terephthalate has a weight-average molecular weight of 8,000 to 50,000.

6. The process for producing a cleaning sheet according to claim 1, wherein the fibrous web consists of fibers containing polyethylene terephthalate.

7. The process for producing a cleaning sheet according to claim 6, wherein the polyethylene terephthalate has a weight-average molecular weight of 8,000 to 50,000.

8. The process for producing a cleaning sheet according to claim 1, wherein the fibrous web consists of a single fiber consisting of polyethylene terephthalate.

9. The process for producing a cleaning sheet according to claim 8, wherein the polyethylene terephthalate has a weight-average molecular weight of 8,000 to 50,000.

* * * * *